US007053308B2

(12) United States Patent
Prats

(10) Patent No.: US 7,053,308 B2
(45) Date of Patent: May 30, 2006

(54) ELECTRICAL CABLE HAVING A REDUCED COEFFICIENT OF FRICTION

(75) Inventor: Agusti Valls Prats, Vilanova i La Geltrú (ES)

(73) Assignee: Pirelli Cables y Sistemas S.A., Vilanova i La Geltru (ES)

( * ) Notice: Subject to any disclaimer, the term of this patent is extended or adjusted under 35 U.S.C. 154(b) by 0 days.

(21) Appl. No.: 10/157,487

(22) Filed: May 30, 2002

(65) Prior Publication Data

US 2002/0139559 A1 Oct. 3, 2002

Related U.S. Application Data

(62) Division of application No. 09/377,729, filed on Aug. 19, 1999, now Pat. No. 6,416,813.

(30) Foreign Application Priority Data

Aug. 19, 1998 (ES) ..... 9801783

(51) Int. Cl.
*H01B 7/00* (2006.01)

(52) U.S. Cl. ..... 174/110 FC; 174/120 R

(58) Field of Classification Search ..... 174/120 R, 174/120 C, 120 FP, 110 FC, 110 R
See application file for complete search history.

(56) References Cited

U.S. PATENT DOCUMENTS

| | | | | |
|---|---|---|---|---|
| 3,321,944 A | | 5/1967 | Ball | 72/46 |
| 3,992,570 A | * | 11/1976 | Beinhaur | 174/135 |
| 4,057,956 A | | 11/1977 | Tolle | 57/164 |
| 4,673,516 A | * | 6/1987 | Berry | 508/214 |
| 6,146,699 A | | 11/2000 | Bonicel et al. | 427/299 |
| 6,188,026 B1 | * | 2/2001 | Cope et al. | 174/120 R |

FOREIGN PATENT DOCUMENTS

| | | | |
|---|---|---|---|
| DE | 2528307 | | 1/1977 |
| EP | 104986 | * | 4/1984 |
| FR | 2674364 | | 3/1991 |

* cited by examiner

*Primary Examiner*—Chau N. Nguyen
(74) *Attorney, Agent, or Firm*—Finnegan, Henderson, Farabow, Garrett & Dunner, L.L.P.

(57) ABSTRACT

The method includes a step in which a conductor wire (4) is coated with a fused plastic material (7) and a step in which said plastic material is cooled, and it is characterized in that it includes a step in which a lubricating material (9) is sprayed onto the surface of the cable (2).

Said cable (2) which includes at least one conductor core (4) and at least one coating of plastic material (7) incorporates a lubricating material (9) on the exterior coating.

The equipment (1) for the manufacturing of electrical cables (2) which includes a reel (3) for supplying a conductor wire (4) to an extruding head (5), which has a tank (6) containing plastic material (7) for coating the aforesaid conducting wire (2), and a reel (11) for taking up the cable (2), includes a device (8) for the application of a lubricating material (9) onto the surface of the cable (2).

6 Claims, 1 Drawing Sheet

ELECTRICAL CABLE HAVING A REDUCED COEFFICIENT OF FRICTION

This is a division of application Ser. No. 09/377,729, filed Aug. 19, 1999, now U.S. Pat. No. 6,416,813, which is incorporated herein by reference.

The present invention relates to an electrical cable and a method and equipment for reducing its coefficient of friction.

BACKGROUND OF THE INVENTION

Electrical cables which include at least one conductor core and at least one coating are well known.

Said cables present the disadvantage that their exterior surface has a high coefficient of friction, so that they are awkward to fit in internal sections of walls and ceilings, since when they come into contact with the adjacent surfaces (pipes, cables, etc.) they become stuck.

In order to overcome said difficulty, alternative materials such as vaselines are currently used to coat the exterior surface of the cable, thereby reducing the coefficient of friction.

In a complementary manner, guides of small diameter are also used, one end of which is inserted through the cavity through which the cable has to pass and the other is attached to the end of the cable which must be inserted into the cavity. Thus, once the guide has emerged at the desired place it is pulled until the end of the cable appears again after having passed through the entire section.

Whatever the method used, the installation of said cables involves a considerable loss of time and an economic cost, since alternative materials are required.

DESCRIPTION OF THE INVENTION

With the method, the cable and the equipment of the invention said disadvantages can be solved, while providing other advantages which will be described below.

The method for the manufacture of electrical cables is characterized in that it includes a step in which a lubricating material is sprayed onto the surface of the cable.

A cable with low coefficient of friction is achieved thereby, so that subsequent installation of the same is considerably simplified, since it slides over the surfaces with which it comes into contact. It also means a clear economic and time improvement, as no type of alternative materials are required for installing it.

According to one characteristic of the invention, the spraying step is carried out between the step of coating the conductor wire with plastic material and the step of cooling said material.

This position of the spraying step in time is important since, when the conductor wire is coated with the plastic material, said material is in a state of fusion (approximately 150° C.), the high temperature of which causes volatilization of the solvents present in the lubricating material, which means that there is greater adherence of said lubricating material on the surface of the plastic material. The subsequent cooling (down to approximately 20° C.) of the plastic material together with the lubricating material leads to drying of the surface, leaving the two materials bonded to form a coating of low coefficient of friction.

Suitable lubricating material can involve the use of a fluorated organic resin, such as a polymer of one or more fluorated monomers selected from amongst, for example, tetrafluoroethylene, vinylidene fluoride, chlorotrifluoroethylene and the like. The use of polytetrafluoroethylene (PTFE) is particularly preferable. The fluorated resin is preferably used in the form of an emulsion or aqueous dispersion.

The electrical cable is characterized in that it incorporates a lubricating material on the exterior coating, which lubricating material is applied by spraying. The exterior coating of the cable is thus well impregnated with said material, forming a fine layer on the plastic material, since it emerges at high pressure and the plastic material is at high temperatures.

The equipment for the manufacturing of electrical cables is characterized in that it includes a device for the application of a lubricating material on the surface of the cable.

Said device includes a box section through which the cable passes, a plurality of nozzles for spraying the lubricating material mounted inside the box section, a tank for said lubricating material, and a pressure pump to carry the lubricating material from the tank to the spraying nozzles.

Moreover, the device also includes a pressure adjusting valve, a level indicator of the lubricating material tank, and a pressure gauge.

BRIEF DESCRIPTION OF THE DRAWINGS

For a better understanding of all that has been outlined, drawings have been attached in which, schematically and solely by way of non-restrictive example, a practical case of embodiment is shown.

In said drawing.

DESCRIPTION OF A PREFERRED EMBODIMENT

Figure 1:
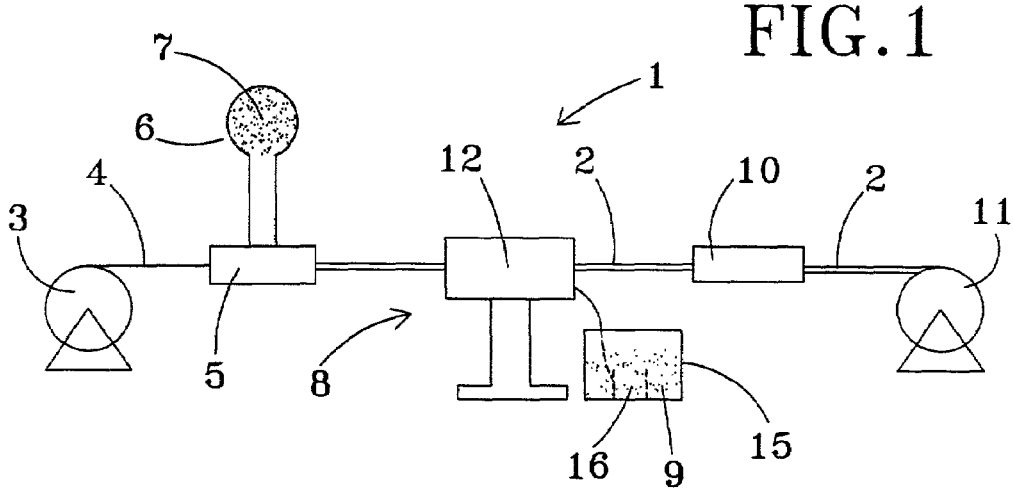
FIG. 1 is a schematic elevation view of the equipment for the manufacturing of the electrical cables, according to the method of the invention.
Figure 2:
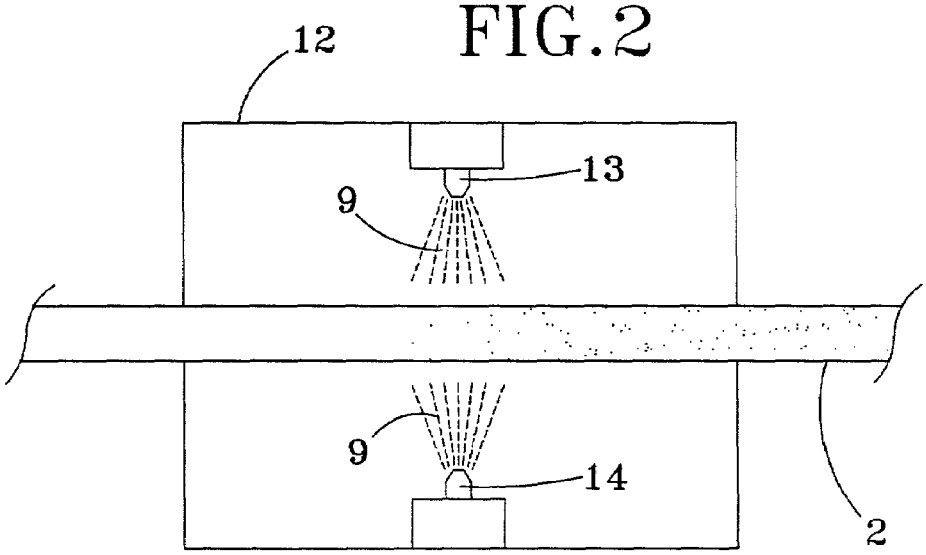
FIG. 2 is a schematic plan view of the device for the application of the lubricating material onto the surface of the cable.

As can be appreciated in the figures, the equipment 1 for manufacturing electrical cables 2 object of the invention includes a reel 3 which supplies conductor wire 4 to an extruding head 5, which in turn includes a tank 6 of plastic material 7; a device 8 for the application of the lubricating material 9 by spraying onto the exterior surface of the cable 9; a cooling box 10 for cooling the exterior surface of plastic material 7 which is in a state of semi-fusion on the conducting wire 4; and a reel 11 for taking up the resulting cable 2.

As can also be seen in the figures, the device 8 for the application of the lubricating material 9 onto the surface of the cable 2 includes a box section 12 through which the cable 2 passes; two nozzles 13, 14 mounted inside the box section 12 for spraying the lubricating material 9; a tank 15 for storing said lubricating material 9; a pressure pump 16 for making the lubricating material 9 travel from the tank 15 to the spraying nozzles 13, 14; a valve (not shown) for adjusting the pressure at which the lubricating material 9 must emerge through the spraying nozzles 13, 14; an indicator (not shown) of the level of the tank 15 for the lubricating material 9; and a pressure gauge (not shown) to measure the pressure of the circulating gases.

The spraying nozzles are of the gas oil burner type, with a flow rate of 25 liters/hour and projection cone angle of 45°.

The pressure pump is an electrical geared pump, having a flow rate of 500 liters/hour, maximum pressure of bar, motor output of 0.5 hp, speed of 1450 rpm, voltage of 220/380 V, ¾" gas aspiration thread and ⅜" gas impulsion thread.

The method of the invention for the obtention of electrical cables 2 includes a first step in which the conductor wire 4 is coated with the fused plastic material which is at an approximate temperature of 150° C.; a second step in which spraying of the lubricating material 9 is carried out, forming a fine layer on the plastic material 7 of the coating, taking advantage of said plastic material being still in state of semi-fusion in order to enhance adherence of the lubricating material 9 on said plastic material, since there occurs volatilization of the solvents which form part of the lubricating material; and a third step in which cooling of the plastic material 7 is carried out (down to approximately 20° C.) together with cooling of the lubricating material 9, to provide an exterior coating of the cable 2 with a low coefficient of friction.

A cable 2 is thus obtained with at least one conducting core and an exterior coating, the main characteristic of which is that its coefficient of friction is low, which makes it easier to install since it slips on the surfaces with which it comes into contact.

It is important to stress that the temperature of the plastic material 7 at the time of the application of the lubricating material 9 must not be less than 85° C.

Despite the fact that reference has been made to specific embodiments of the invention, it will be clear to experts in the subject that the cable, the method and the equipment described can be varied and modified in many ways, and that all the details mentioned can be replaced by others which are technically equivalent without departing from the sphere of protection defined by the attached claims.

For example, the cables 2 on which the lubricating material 9 is applied can be of any desired configuration.

It has been found experimentally that the use of an aqueous emulsion of a fluorated, liquid and translucent organic resin, of the polytetrafluoroethylene (PTFE) type is suitable for providing a considerable reduction of the coefficient of friction of the cable, which means that it is easier to install without adding any external element to it, which is one of the objectives sought in the present invention.

It is advisable for the aforesaid aqueous emulsion to have a density of 1.0+0.02 g/ml and a boiling point of 100° C.

The invention claimed is:

1. An electrical cable comprising:

at least one conductor core, at least one coating of plastic material on the at least one conductor core, wherein said plastic material is impregnated with an aqueous emulsion of a lubricating material that comprises a liquid, fluorated organic resin.

2. The electrical cable of claim 1, wherein the lubricating material impregnates the plastic material under a condition in which the plastic material has a temperature of approximately 150° C.

3. The electrical cable of claim 1, wherein the lubricating material comprises polytetrafluoroethlylene.

4. The electrical cable of claim 1, wherein the lubricating material comprises polyvinylidene fluoride.

5. The electrical cable of claim 1, wherein the lubricating material comprises polychlorotrifluoroethylene.

6. The electrical cable of claim 1, wherein the lubricating material impregnates the plastic material under a condition in which the plastic material has a temperature of approximately 85° C.

* * * * *